US005605087A

United States Patent [19]

Beadman

[11] Patent Number: 5,605,087

[45] Date of Patent: Feb. 25, 1997

[54] TAPE CUTTING APPARATUS

[75] Inventor: Michael A. Beadman, Royston, United Kingdom

[73] Assignee: Esselte N.V., St. Niklass, Belgium

[21] Appl. No.: 178,689

[22] Filed: Jan. 10, 1994

[30] Foreign Application Priority Data

Jan. 13, 1993 [GB] United Kingdom ..... 9300579

[51] Int. Cl.[6] ..... B26D 3/08; B41J 11/70

[52] U.S. Cl. ..... 83/881; 83/69; 83/526; 400/621

[58] Field of Search ..... 83/69, 203, 526, 83/861, 862, 879, 881, 882, 883; 400/621

[56] References Cited

U.S. PATENT DOCUMENTS

| | | | |
|---|---|---|---|
| 4,494,435 | 1/1985 | Lindsay | 83/880 |
| 5,007,572 | 4/1991 | Chung-Cheng | 227/7 |
| 5,066,152 | 11/1991 | Kuzuya et al. | 83/861 X |
| 5,222,818 | 6/1993 | Akiyama et al. | 400/621 X |

FOREIGN PATENT DOCUMENTS

| | | |
|---|---|---|
| 0084349 | 7/1983 | European Pat. Off. . |
| 0510768 | 10/1992 | European Pat. Off. . |
| 1245444 | 9/1971 | United Kingdom . |
| 1423463 | 2/1976 | United Kingdom . |
| 2146281 | 4/1985 | United Kingdom . |

*Primary Examiner*—Rinaldi I. Rada
*Assistant Examiner*—Raymond D. Woods
*Attorney, Agent, or Firm*—Pennie & Edmonds

[57] ABSTRACT

A tape cutting apparatus which provides for cutting a multi-layered tape through only one layer of the tape. The apparatus includes a cutting device with a cutting blade wherein the cutting device is actuated by a drive mechanism and the position of the cutting device is controlled by a position controller. The apparatus further provides a braking mechanism to ensure that the cut is terminated at the proper position.

18 Claims, 6 Drawing Sheets

FIG. 7a
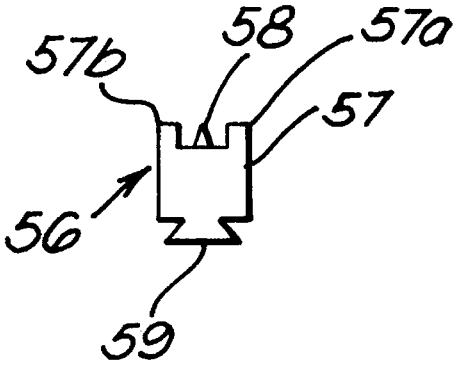
FIG. 7b
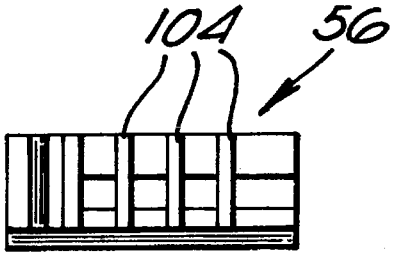
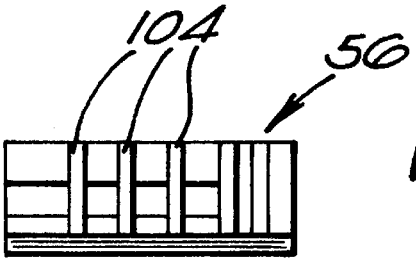
FIG. 7c
FIG. 7d
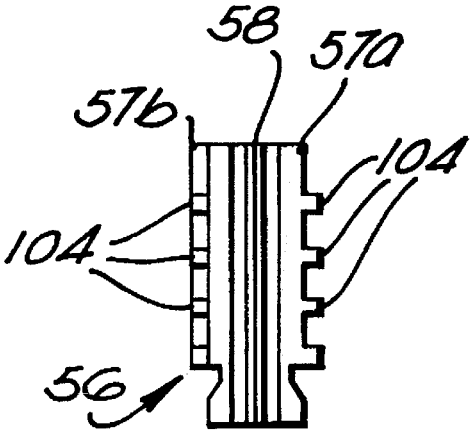
FIG. 7e
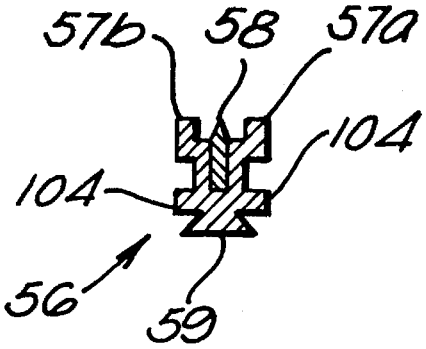

TAPE CUTTING APPARATUS

FIELD OF THE INVENTION

This invention relates to a tape cutting apparatus and is particularly concerned with cutting tape in printing devices.

BACKGROUND OF THE INVENTION

Thermal printing devices of the general type with which the present invention is particularly but not exclusively concerned are known. They operate with a supply of tape arranged to receive an image and a means for transferring an image onto the tape. In one known device, a tape holding case holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive.

Once an image or message has been printed on the tape, it is desired to cut off that portion of the tape to enable it to be used as a label. For this purpose, it is necessary to remove the releaseable backing layer from the upper layer to enable the upper layer to be secured to a surface by means of the adhesive layer. With existing printing devices, it is difficult to remove the releaseable backing layer from the upper layer: it is necessary first to separate the closely adhered end portions of the releaseable backing layer and the upper layer, for example using a fingernail or tweezers so that the separated end portion of the releaseable backing layer can be finger gripped to peel it off the adhesive layer. This is a relatively difficult procedure and furthermore can result in the ends of the label being damaged in the process.

There have been several attempts to solve this problem. One approach is to provide a so-called tab cut. In these devices, a first cut is made completely through all the layers of the tape to cut off a portion of the tape and at the same time a cut is made through only one layer of the tape. This provides a "tab" which, in theory, can be peeled away reasonably easily. In embossing label makers a system is known whereby a sharp steel blade is used to cut the plastic label against a soft, serrated anvil, such that the soft plastic backing layer remains substantially intact. Such a system does not work satisfactorily with electronic label makers as the backing layer used is normally paper and the plastic label tape is thinner than normal embossing tape. Any attempt to use a similar approach in an electronic label printer would require high cutting forces and frequent replacement of the soft cutting anvil. Although there have been several proposals, no such tab cut has successfully been implemented in a thermal printing device. By way of example, reference is made to EP-A-0319209 which describes one attempt to form a tab cut system. In EP-A-319209, the tab cut is made only through the thickness of the backing layer which is applied as a release layer of double-sided adhesive tape.

In that system, two blades are provided on a cutter support, the blades having different heights so that they penetrate the backing layer to different extents. In this way, one blade cuts through all the layers of the tape at one location while the other blade cuts only through the releaseable backing layer.

One problem which arises with the tab cutting apparatus described in EP-A-0319209 is the control of the height of the blades to ensure that there is reliability in that one blade always cuts through the whole tape and the other blade only cuts through the backing layer. This is difficult to achieve where tapes of differing thicknesses are provided for use with the cutting apparatus. A variation in thickness such that could arise due to normal manufacturing tolerances could even give rise to problems in this respect.

Another difficulty is that the tab cut depends on making two cuts simultaneously from the common cutter support, requiring increased force to be applied by the user. The force is applied manually and the force applied by some users may be insufficient to provide a proper tab cut, causing the label to be damaged when the backing is removed. Conversely too great a force may cause both tapes to be fully cut in both positions, leaving a portion of material within the cutting mechanism.

These problems have meant that to date the above described system has not been successfully implemented.

In this regard reference is made to copending U.S. Application Ser. No. 08/069,256, now U.S. Pat. No. 5,458,423 in the name of the present applicant which describes a tape cutting apparatus in which a tab cut is implemented using a drive means to provide the force for the tab cutting blade. The contents of that Application are incorporated herein by reference. When a motor is used to drive the tab cutting blade, the size of motor is limited by the size of the printing apparatus and so a very high gear ratio is required for a small motor to generate the force required to produce a tab cut, some 15 kilogram force. Due to the high gear ratio, the mechanical inertia in the system will be such that the motor will continue to rotate even when a supply to the motor has been removed. The motor is a small D.C. motor having a wound rotor and a permanent magnet stator. When the current supply to the rotor windings is removed, the rotor ceases to be driven by interaction with the magnetic field of the permanent magnet. However, residual mechanical inertia will mean that the rotor continues to rotate even in the absence of magnetic drive. Thus, as the motor effectively controls the position of the tab cutting blade in relation to the tape, if the motor overruns after a complete tab cut has been implemented, the tab cutting blade will end up in a position in relation to the blade which could cause jamming of the tape. The present invention has been developed to overcome this problem.

SUMMARY OF THE INVENTION

According to the present invention there is provided a tape cutting apparatus comprising cutting means arranged to cut through one layer only of a multilayer tape, drive means controllable to actuate the cutting means, position control means for controlling the position of the cutting means between an inactive position and a cutting position; and means controllable in response to the position control means for providing a braking action to the drive means when the cutting means has reached the inactive position.

Preferably the drive means is an electric motor and the braking means comprises means for short circuiting the supply to the rotor windings of the electric motor. This causes a current to flow in the rotor windings which interacts with the magnetic field set up by permanent magnets of the stator to provide a braking action to the rotor. The short circuit can either be provided directly or via a low resistance across the motor terminals. This ensures that the motor stops almost immediately when the cutting means is in the inactive position and does not move the cutting means beyond that position. The rotor windings can be short circuited because they are easily accessible through the bushes of the D.C. motor.

The inactive position of the cutting means is the position furthest away from the tape which is to be cut. The present invention thus reliably ensures that after each tab cut has been implemented the cutting means remains in the position furthest away from the tape, so that the tape can be fed freely and without risk of jamming.

Preferably the position control means comprises a cam having a track formed therein, the cutting means including a support arm carrying a cutting blade, the support arm having an end riding in said track and the drive means causing rotation of said cam. The cam track is such that the cutting blade is moved from its inactive position to its cutting position during one complete rotation of the cam.

Preferably the means responsive to the position control means is a switch actuatable by a protrusion on the position control means, the protrusion being arranged in such a position that it actuates the switch when the cutting means is in the inactive position. The switch then controls circuitry to apply a braking action to the drive means.

Preferably, the tape cutting apparatus further includes a second cutting means which is operable to cut through all of the layers of said multilayer tape. In the described embodiment, the second cutting means is actuated by the same drive means as the first-mentioned cutting means so that a portion of tape can be cut off while a cut is also made through only one layer of the tape at a position spaced apart from the cut off edge. This enables labels with tabs to be produced.

The second cutting means can comprise two blades cooperable to form a scissor cut, for example in which one of the blades is fixed while the other of the blades is arranged to move towards the fixed blade when actuated by the drive means.

The cutting blade of the first-mentioned cutting means is preferably resiliently mounted and acts against an anvil which can form part of the tape cutting apparatus or can be provided as part of a thermal printing device with which the tape cutting apparatus is to cooperate.

Where both cutting means are arranged to be driven from the common drive means, means can be provided for disconnecting the second cutting means while the first-mentioned cutting means remains driven thereby. In this way, it is possible for a thermal printing device to produce a continuous strip of labels, separated one from another by a cut but being secured to a common backing layer.

Another aspect to providing a successful implementation of a tab cut is to enable the depth of cut to be controlled carefully. Only in this way can a reliable tab cut be produced which cuts only through one layer of the multilayer tape leaving the remaining layers intact. Preferably therefore the cutting means comprises a tab cutting assembly which comprises an injection moulded plastics holder receiving a cutting blade. The tab cutting assembly is made by providing a mould, locating the cutting blade within the mould, injecting plastic material into the mould, and allowing the plastics material to set. In this way, a very close tolerance can be achieved on the blade height of the order of 20 um. Typically 100 to 120 microns of blade height is required for cutting through a 75 micron polyester tape with a total thickness of 135 microns including adhesive backing paper.

Preferably the cutting blade is made from a ceramic material since this typically requires as low as a half to one third the force of a steel blade for the same cut. In fact, it has been discovered that with the thin polyester material used as the image receiving tape, the blade does not actually cut the material in the normal sense of the word but rather cracks it. A ceramic blade is ideal for this.

Preferably the holder has supporting surfaces which extend below a surface of the holder from which the blade protrudes, which hold the tape and prevent the blade from piercing more than the top layer of the multilayer tape.

For a better understanding of the present invention, and to show how the same may be carried into effect, reference will now be made by way of example, to the accompanying drawing.

BRIEF DESCRIPTION OF THE DRAWINGS

FIGS. 7*a* to 7*e* show an insert moulded tab cut assembly;

DESCRIPTION OF PREFERRED EMBODIMENT

Figure 1:
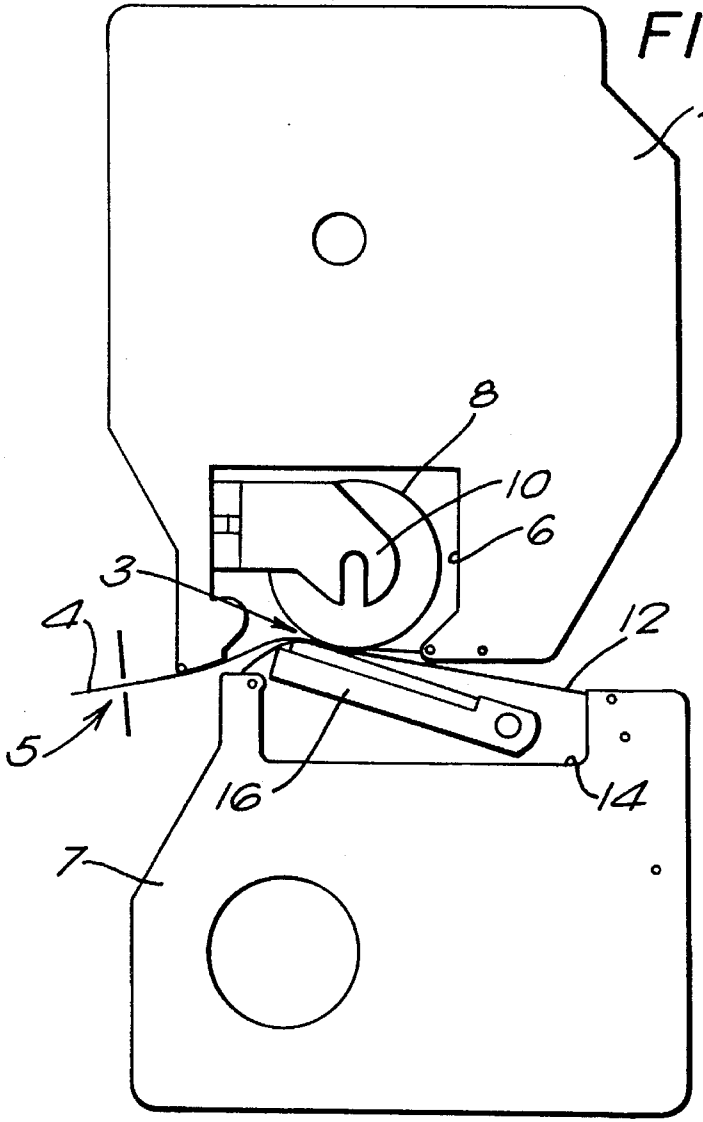
FIG. 1 is a plan view showing two cassettes inserted in a printing device.

FIG. 1 shows in plan view two cassettes arranged in a printing device. The upper cassette 2 contains a supply of image receiving tape 4 which passes through a print zone 3 of the printer to an outlet 5 of the printer. The image receiving tape 4 comprises an upper layer 4*a* for receiving a printed image on one of its surfaces and having its other surface coated with an adhesive layer to which is secured a releaseable backing layer 4*b* (see FIG. 5). The cassette 2 has a recess 6 for accommodating a platen 8 of the printer. The platen 8 is mounted for rotation within a cage moulding 10. The platen 8 could as an alternative be mounted for rotation on a pin.

The lower cassette 7 contains a thermal transfer ribbon 12 which extends from a supply spool to a take-up spool within the cassette 7. The thermal transfer ribbon 12 extends through the print zone 3 in overlap with the image receiving tape 4. The cassette 7 has a recess 14 for receiving a print head 16 of the printer. The print head 16 is movable between an operative position, shown in FIG. 1, in which it is in contact with the platen 8 and holds the thermal transfer ribbon 12 and the image receiving tape 4 in overlap between the print head and the platen and an inoperative position in which it is moved away from the platen 8 to release the thermal transfer ribbon 12 and image receiving tape 4. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

Figure 2:
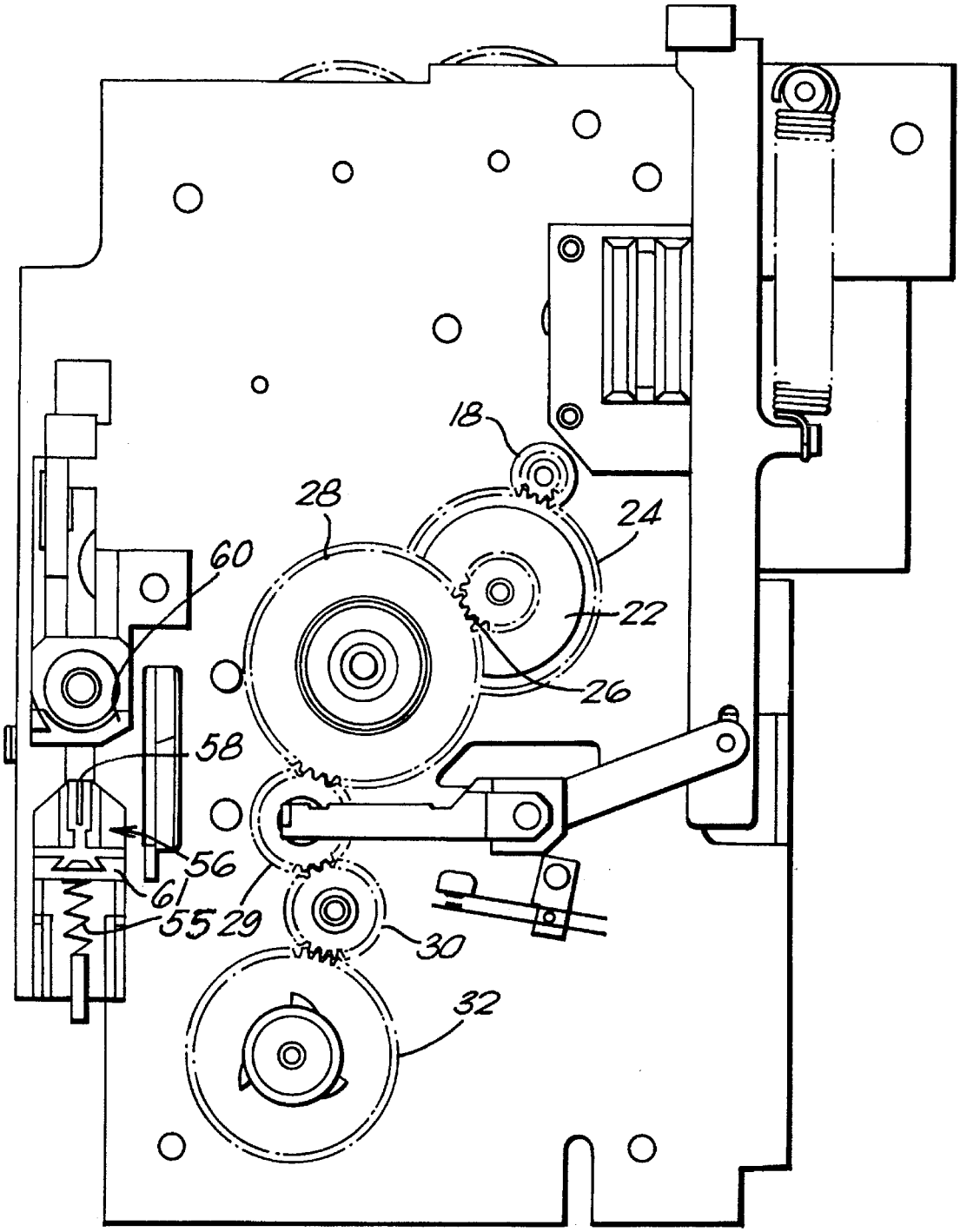
FIG. 2 is a plan view seen from the top of a cassette bay of the printing device.

FIG. 2 shows the drive train of the printing device. The printing device carries a stepper motor 18 secured to the base of the printing device by a bracket 20 (see FIG. 3). The motor drives a double radius gear 22 on its larger diameter 24 while its smaller diameter 26 drives a second gear wheel 28. The second gear wheel 28 drives a gear 29 which causes the platen 8 to rotate and which also drives through an intermediate gear 30 a third gear 32 which drives the take-up spool for the ink ribbon in the cassette 4.

The stepper motor 18 drives the platen 8 in steps so that for each position of the platen a column of pixels is printed on the image receiving tape 4. The platen 8 drives the image receiving tape through the print zone under the action of its own rotation. The rotation of the platen and the energisation of the print head 16 are controlled by a microprocessor as described in our copending U.S. Application Ser. No. 08/069,256, now U.S. Pat. No. 5,458,423, the contents of which are incorporated herein by reference.

Figure 4:
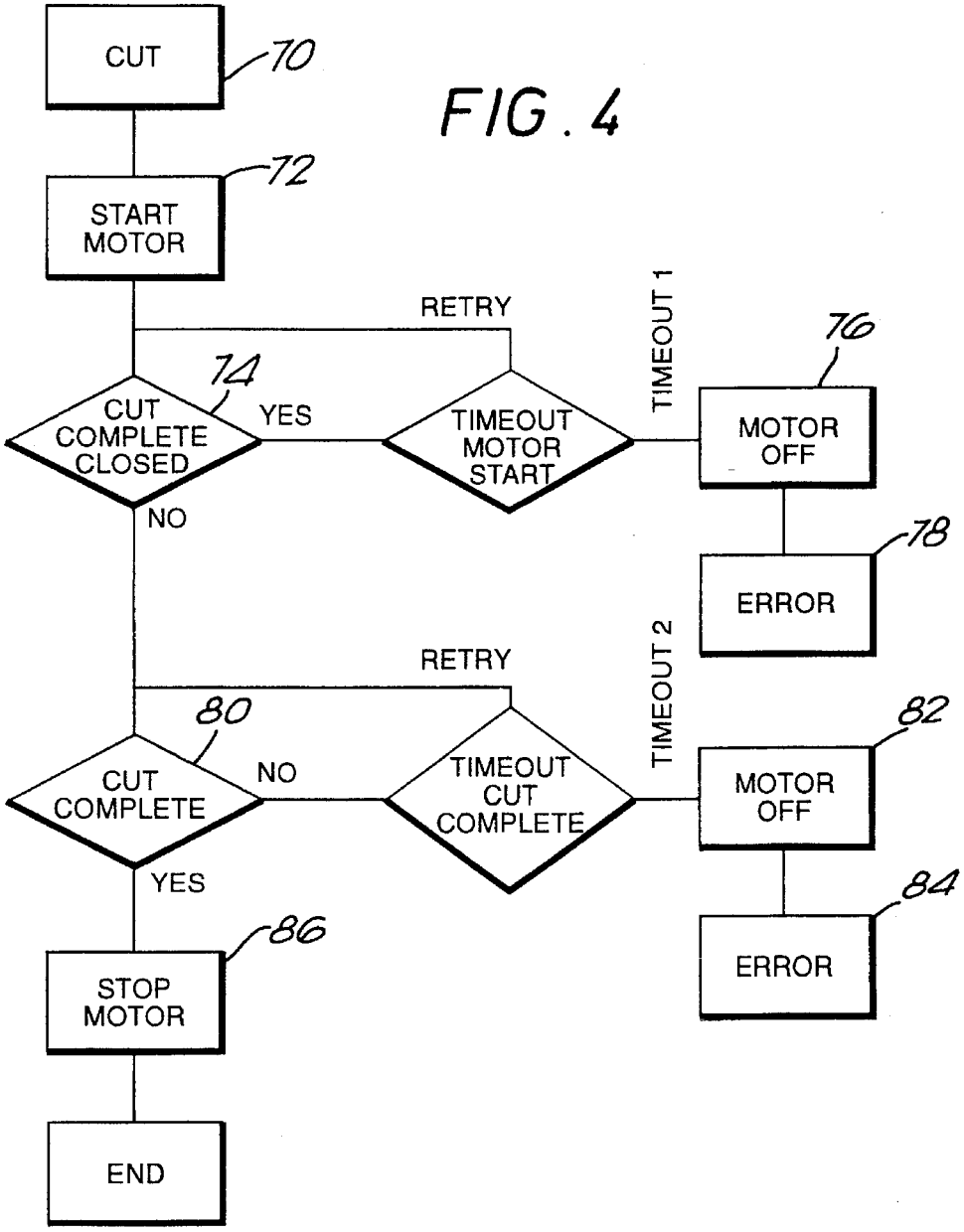
FIG. 4 is a flow chart illustrating the control steps of the present invention.

FIG. 2 also shows a tab cutting assembly comprising a spring loaded blade holder designated generally by reference numeral 56 holding a blade 58 which can be forced against an anvil 60 (see FIG. 4). The blade holder 56 is biased by a spring 55. In an alternative arrangement, the anvil 60 could be biased instead of the blade holder 56. The blade 58 is not designed to cut entirely through the tape but is designed to cut only through the image receiving layer **4*a* of the image receiving tape 4 and not through the releaseable backing layer 4*b***.

Figure 3:
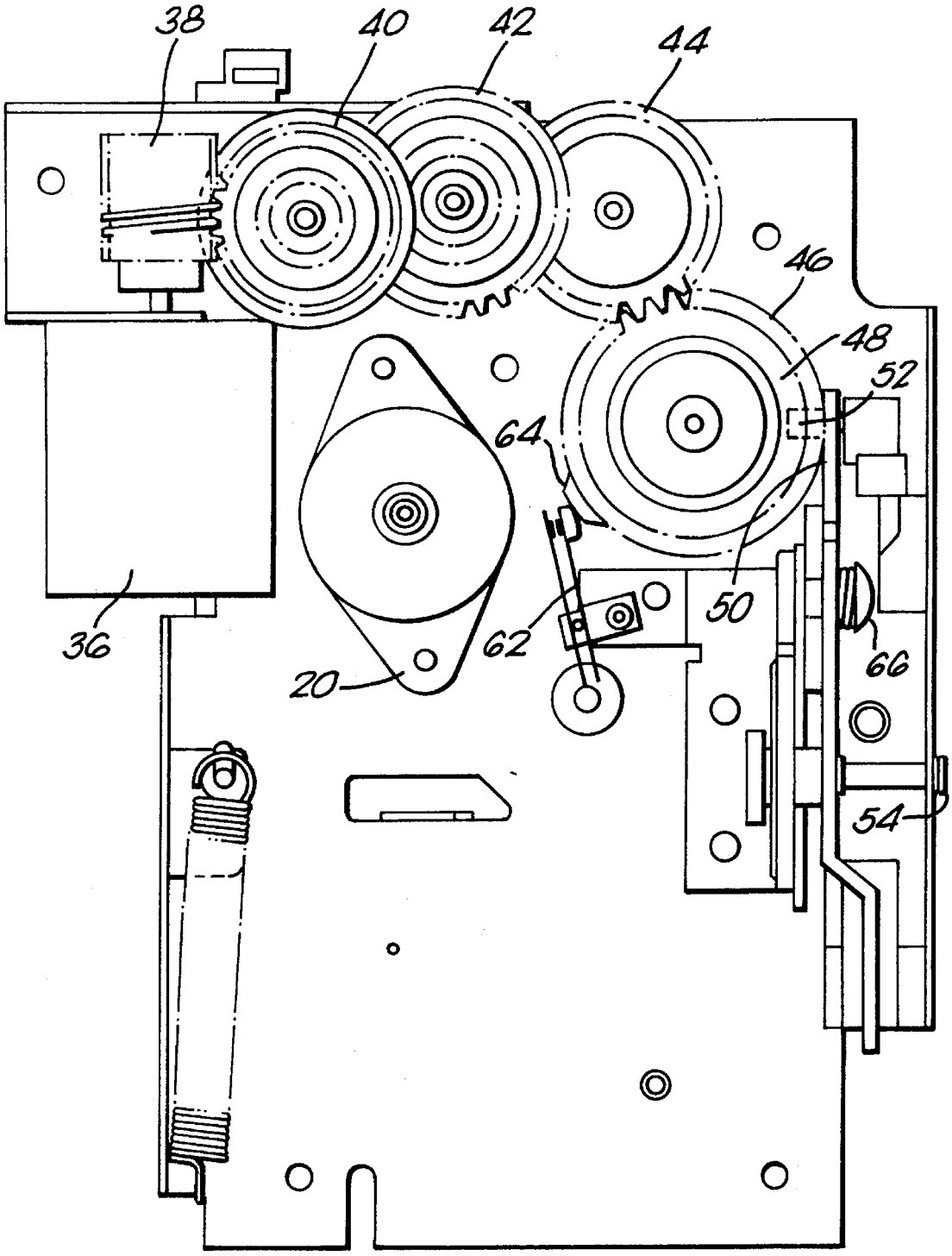
FIG. 3 is a view taken from the underneath of the bay of a printing device.

FIG. 3 is an underside view showing a cutting mechanism of the printing device. A cutter motor 36 drives a worm gear 38. This drives a gear train comprising three gears 40,42,44, the last gear 44 then driving a cam 46. The cam 46 has in its surface a cam track 48 extending circumferentially and asymmetrically. A tab cut lever arm 50 runs in the cam track 48 via a pin 52. The tab cut lever arm is pivotably mounted about a pivot point 54 and is arranged so that, as the cam rotates, it is brought into contact with the blade holder 56 to bring the blade 58 against the anvil.

Figure 5:
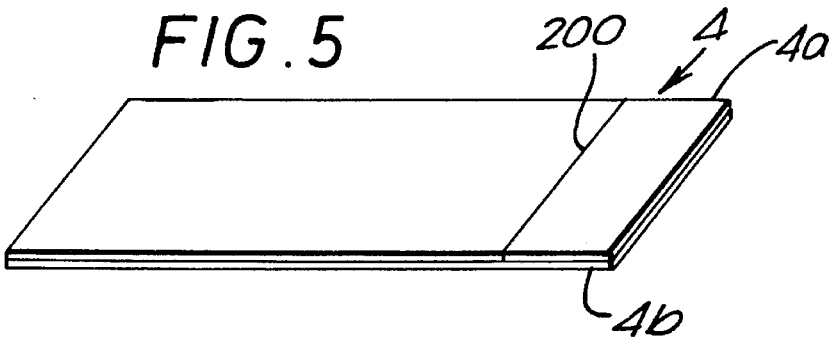
FIG. 5 shows a label with a tab cut.

When the image receiving tape 4 lies between the blade 58 and the anvil 60, the blade 58 cracks the upper polyester layer 4a while leaving the backing layer **4*b* intact to make a tab cut as designated by reference numeral 200 in FIG. 5. In the preferred embodiment and as described in our copending U.S. Application Ser. No. 08/069,256, now U.S. Pat. No. 5,458,423 a cut is simultaneously made through all of the layers of the image receiving tape to cut off a portion of tape once printed by two cooperating blades operating as scissors. The scissors can be driven by the motor 36 to cut off a portion of tape while the blade 58** makes the "tab-cut".

The cutting mechanism operates as follows. As the cam 46 rotates, the tab cut lever arm 50 is caused to move in the track 48 to bring the blade holder 56 from an inactive position spaced from the tape 4 into a cutting position where it brings the blade 58 against the anvil 60 with the tape in between. At the same time, the first scissor blade is brought into contact with the second scissor blade to perform a scissor cut. Thus, a portion of a printed tape is cut off while a tab cut 200 (see FIG. 5) is made at a short distance from the main cut.

Figure 6:
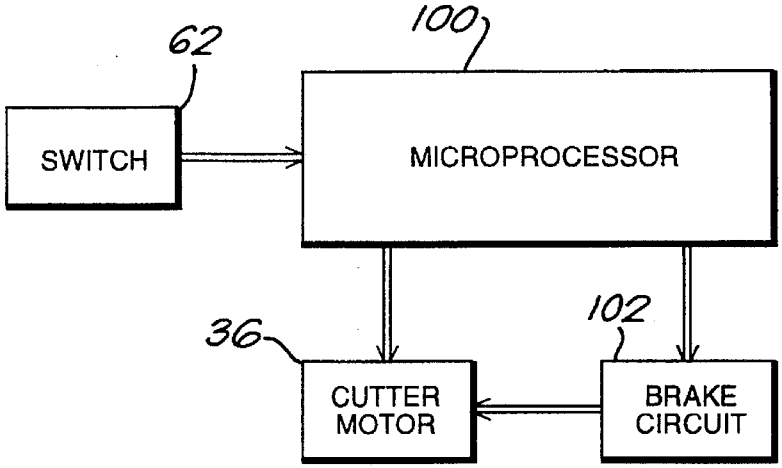
FIG. 6 is a block diagram of motor control circuitry.

The dynamic braking system of the present invention will now be described. The cam 46 carries on its outer surface a protrusion 64. A microswitch 62 is mounted underneath the cassette receiving bay as shown in FIG. 3. FIG. 6 is a block diagram showing the main elements of the motor control circuitry. The microswitch 62 provides a signal to a microprocessor 100 for controlling the motor 36 and a brake circuit 102 as described below more clearly with reference to FIG. 4. The microswitch is normally open during rotation of the cam, except when the protrusion 64 is brought into contact with it, whereupon it is closed. The protrusion 64 is located so that it contacts the microswitch 62 in a position that the blade 58 is at its furthest location from the tape 4. The motor is an ordinary electric motor having a stator comprising permanent magnets which provide a magnetic field within which a wound rotor rotates. On receipt of a cut instruction, current is supplied to the rotor windings of the motor and the rotor rotates thus driving the worm gear 38, the gear train 40,42,44 and thence the cam 46. The cam 46 completes a full rotation bringing the blade 58 from its position furthest away from the tape 4 into contact with the tape to make a tab cut and then returning the blade 58 to its furthest position. In the basic implementation as described in our earlier Application, at this point the current supplied to the rotor windings of the motor is ceased. However, there is still a significant amount of inertial energy in the drive mechanism which means that the rotor of the motor continues to rotate for a short time even after current supply to the rotor windings has been cut off. This is prevented in the present invention by the protrusion 64 coming into contact with the microswitch 62 with the blade 58 in its position furthest away from the tape. The microswitch passes a signal to the microprocessor 100 which responds by issuing a signal to the brake circuit 102 which acts to short circuit the terminals of the motor directly or through a low resistance thereby applying a braking torque and bringing the rotor rapidly to a standstill.

This is shown more completely in the flow chart of FIG. 4. A cut instruction 70 causes the microprocessor 100 to supply to the motor 36 a start motor instruction 72.

A "cut complete closed" loop 74 then begins with a time out of a few seconds. That is, the state of the switch 62 is checked to ensure that the switch state changes from its closed position to its open position within a few seconds. If it does not, this means that the cam 46 has not started to rotate and a time out 1 signal causes a motor off instruction 76 to be passed to the microprocessor which displays an error signal 78 on the printing device.

Assuming that the cam 46 does begin to rotate within the first few seconds, a "cut complete" loop 80 is commenced with a time out in seconds set to match the rotation time of the cam. Thus, the microprocessor now checks that the switch 62 changes its state from open to closed in a time to match the rotation time of the cam 46. If it does not change its state within this time, a time out 2 signal causes a motor off signal 82 to be passed to the microprocessor which causes an error signal 84 to be displayed on the printing device.

Assuming that the printing device is working properly, the "cut complete" loop 80 will detect a change in the switch state from open to closed as the blade 58 has performed a cut and returned to its inactive position. As soon as this change in switch state is detected, a stop motor signal 86 causes the microprocessor to actuate the brake circuit 102 to short circuit the motor terminals.

Reference is now made to FIGS. **7*a* to 7*e* to describe an accurately constructed tab cut assembly. FIG. 7*a* is a view of the tab cut assembly from one end, comprising the blade holder 56 with a blade 58. The blade holder 56 comprises an insert moulded plastics body 57 having two supporting surfaces 57***a*, 57*b* which extend on either side of the blade 58. It also has a lower protrusion 59 with angled surfaces by which the holder can be resiliently mounted in a support body 61 (see FIG. 2).

FIGS. 7*b* and 7*c* are side views of the plastics body 57, showing that it has a plurality of vertical ribs 104 on each side. FIG. 7*d* is a view from above of the body 57 and FIG. 7*e* is a section taken through the body 57 and showing the ribs and the blade in more detail. The ribs provide the body 57 with additional strength.

The assembly is such that the tip of the blade 58 protrudes beyond the support surfaces 57*a*, 57*b* by a small but controllable amount, for example 100 to 120 microns, with a tolerance of the order of 20 um.

Figure 8:
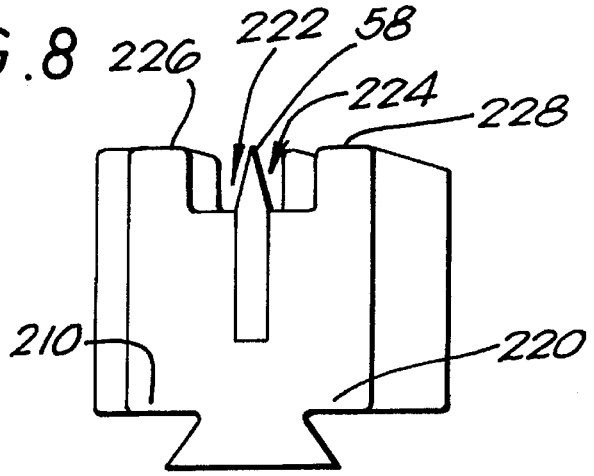
FIG. 8 shows an end view of the tab cut assembly in more detail.

FIG. 8 shows an end view of the moulded tab cut assembly in more detail.

Reference numerals 210,220 show regions into which plastic can be injected into the mould in two balanced positions such that the blade 58 is not shattered, or the cutting edge damaged during injection of the plastic.

Grooves 222,224 are provided either side of the blade 58 to ensure that adhesive build-up in use does not stop the blade 58 from cutting through the upper layer of the tape by the correct distance.

The surfaces 226,228 of the support portions 57*a*, 57*b* which define the controlled cutting depth can be moulded accurately and are close enough to the blade that a flat, hard, support can be produced to allow reliable cutting to be achieved.

Features are included in the blade shape to ensure it is retained securely in the finished moulding. Furthermore, the moulded wall thicknesses are such that the component shrinks after cooling whilst maintaining the blade protrusion dimensions and tolerances.

Figure 9:
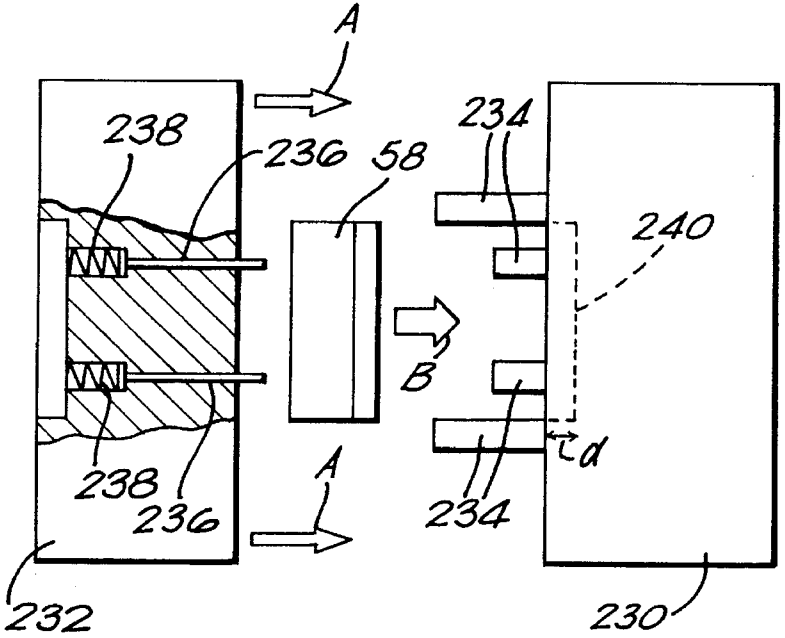
FIG. 9 is a side view of two mould halves of an insert moulding assembly.

FIG. 9 is a side view showing two halves of an insert moulding assembly for manufacturing the insert moulded tab cut assembly described herein. The insert mould assembly comprises a fixed mould half 230 and a moving mould half 232. The mould halves 230,232 define, when mated, an inner mould cavity having a mould surface conforming to the desired shape of the blade holder 56. The fixed mould half 230 is provided with positioning pins 234 which serve to locate the blade 58 in a manner which will be described in more detail hereinafter with reference to FIG. 10. For a similar purpose, the moving mould half 232 is provided with spring-loaded pins 236, reference numeral 238 denoting the springs. The arrow A in FIG. 9 illustrates the direction of movement of the moving mould half 232 to the fixed mould half 230. The arrow B denotes the movement of the blade 58 towards the positioning pins, cutting side to the right in FIG. 9.

Figure 10:
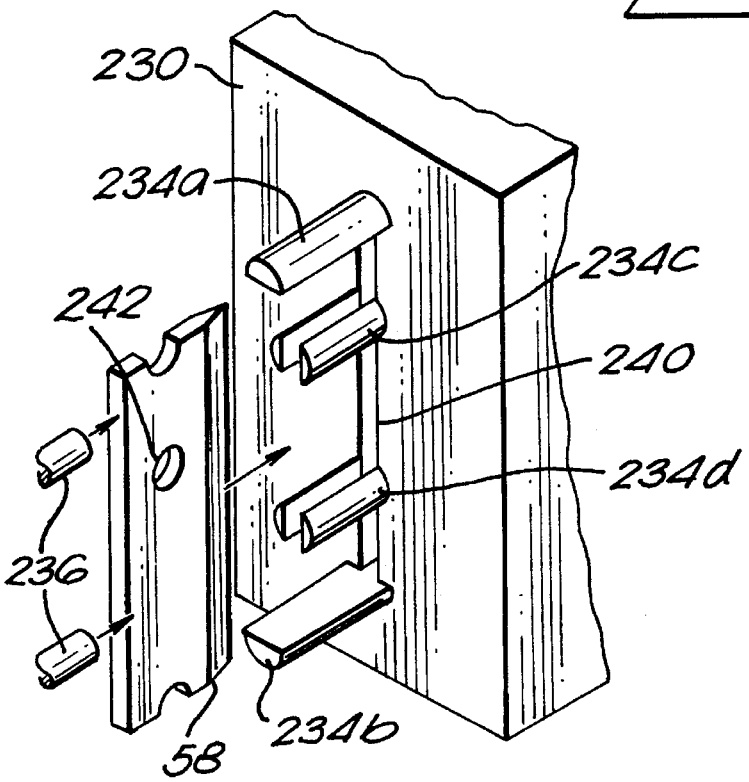
FIG. 10 shows the blade location in more detail.

FIG. 10 shows how the blade 58 is located against the fixed mould half 230. The spring-loaded pins of the moving mould half 232 cause the blade 58 to be sprung towards the positioning pins of the fixed mould half 230, thereby accurately guiding and locating it. The positioning pins 234 include upper and lower pins 234*a*, 234*b* for guiding opposed longitudinal edges of the blade 58 and intermediate positioning pins 234*c*, 234*d* which are split to receive and locate the blade on opposed surfaces thereof. The fixed mould half 230 is provided with a recess 240 which has a depth d defining the protruding height of the blade 58.

The blade 58 has an aperture 242 through which plastic material flows and thus causes the blade to be held firmly in the final moulded holder. Another possibility is to provide vertical ribs which extend along opposite blade surfaces.

Thus, the present invention provides a system which reliably cuts a plastic label through from the front whilst leaving the peelable release layer substantially intact.

In addition it provides a system which can cut reliably tapes of differing widths, for example 6 mm, 12 mm and 19 mm in a fully automatic cutting system. The described cutter can cut the label tape reliably from the front to a very tightly controlled depth, typically 100 microns, for a 74 micron plastic tape having a total thickness of 135 microns including adhesive and peelable release layer. Further, the cutter anvil is not damaged and the blade has a long life.

These attributes are provided in one aspect by the ceramic blade which is insert moulded into the plastic body to provide a very accurate blade protrusion distance. Insert moulding and ceramic blades are of course known per se but the special combination required to achieve the desired performance for this application are new. In particular, by selecting the correct ceramic material and grinding conditions it is possible to produce a blade which can cut through the tape with forces of less than half that required with steel blades. Further, by selecting the correct plastic material for moulding it is possible to achieve a blade protrusion tolerance of less than 20 microns. This tolerance is for example significantly less than the material shrinkage encountered during cooling after the moulded process. Also, by correct design of the moulding tool it is possible to ensure that the desired tolerances are achieved without damaging the ceramic blade, or its cutting edge, during the moulding process.

What is claimed is:

1. A tape cutting apparatus comprising:

cutting means comprising a cutting blade arranged to cut through one layer only of a multilayer tape;

a tape supporting surface for supporting the multilayer tape during cutting;

drive means controllable to actuate the cutting means;

position control means for controlling the position of the cutting means between an inactive position and a cutting position; and braking means, controllable in response to the position control means, for providing a braking action to the drive means when the cutting means has reached the inactive position.

2. A tape cutting apparatus according to claim 1, wherein the drive means comprises an electric motor and the braking means comprises means for short circuiting a supply to rotor windings of the electric motor.

3. A tape cutting apparatus according to claim 1 or 2, wherein the position control means comprises a cam having a track formed therein, the cutting means including a support arm carrying the cutting blade with the support arm having an end riding in said track and the drive means causing rotation of said cam.

4. A tape cutting apparatus according to claim 1 or 2, wherein the braking means comprises a switch actuatable by a protrusion on the position control means, the protrusion being arranged in such a position that it actuates the switch when the cutting means is in the inactive position.

5. A tape cutting apparatus according to claim 1, wherein the cutting means comprises a tab cutting assembly comprising a plastic holder for receiving the cutting blade.

6. A tape cutting apparatus according to claim 5, wherein the holder has supporting surfaces which extend below a surface of the holder from which the blade protrudes, whereby a penetration depth of the blade is controlled during cutting.

7. A tape cutting apparatus according to claim 5 or 6, wherein a cutting portion of the blade protruding from said holder is in the range of 100 to 120 microns.

8. A tape cutting apparatus according to claim 5 or 6, wherein the blade is made from a ceramic material.

9. A tape cutting apparatus according to claim 6, wherein the blade and the supporting surfaces are positioned apart by a predetermined distance such that at least one gap is formed therebetween.

10. A combination comprising a tape having a predetermined thickness; and a tape cutting apparatus comprising:

cutting means comprising a cutting blade arranged to cut through a portion of the thickness of the tape;

a tape supporting surface for supporting the tape during cutting;

drive means controllable to actuate the cutting means;

position control means for controlling the position of the cutting means between an inactive position and a cutting position; and braking means, controllable in response to the position control means, for providing a braking action to the drive means when the cutting means has reached the inactive position.

11. A combination according to claim 10, wherein the drive means comprises an electric motor and the braking means comprises means for short circuiting a supply to rotor windings of the electric motor.

12. A combination according to claim 10, wherein the position control means comprises a cam having a track formed therein, the cutting means including a support arm carrying the cutting blade with the support arm having an end riding in said track and the drive means causing rotation of said cam.

13. A combination according to claim 10, wherein the braking means comprises a switch actuatable by a protrusion on the position control means, the protrusion being arranged in such a position that it actuates the switch when the cutting means is in the inactive position.

14. A combination according to claim 10, wherein the cutting means comprises a tab cutting assembly comprising a plastic holder for receiving the cutting blade.

15. A combination according to claim 14, wherein the holder has supporting surfaces which extend below a surface from which the blade protrudes to control penetration of the blade into the tape during cutting.

16. A combination according to claim 15, wherein the blade and the supporting surfaces are positioned apart at a predetermined distance such that at least one gap is formed therebetween.

17. A combination according to claim 14, wherein the blade is made from a ceramic material.

18. A combination according to claim 10 wherein the tape is a multi-layer tape having at least first and second layers and wherein the cutting blade cuts through only one of the layers.

* * * * *